US005232210A

United States Patent [19]

Saeki et al.

[11] Patent Number: 5,232,210

[45] Date of Patent: Aug. 3, 1993

[54] DOCUMENT FEEDING METHOD FOR A RECYCLING AUTOMATIC DOCUMENT FEEDER

[75] Inventors: Shirou Saeki, Yokohama; Hiroyuki Ishizaki, Ogaki, both of Japan

[73] Assignee: Ricoh Company, Ltd., Tokyo, Japan

[21] Appl. No.: 914,034

[22] Filed: Jul. 14, 1992

Related U.S. Application Data

[63] Continuation of Ser. No. 723,202, Jun. 28, 1991, abandoned.

[30] Foreign Application Priority Data

Jul. 3, 1990 [JP] Japan ..... 2-176542

[51] Int. Cl.[5] ..... B65H 83/00

[52] U.S. Cl. ..... 271/3; 271/4; 271/6; 271/7

[58] Field of Search ..... 271/3, 3.1, 4–7; 355/321, 308, 311, 322

[56] References Cited

U.S. PATENT DOCUMENTS

| | | | |
|---|---|---|---|
| 3,656,673 | 4/1972 | Erickson | 226/2 |
| 3,865,481 | 2/1975 | Washio et al. | 355/310 |
| 3,865,482 | 2/1975 | Bendall et al. | 355/308 |
| 4,320,960 | 3/1982 | Ward et al. | 355/75 X |
| 4,485,949 | 12/1984 | Gebhart et al. | 226/2 |
| 4,579,327 | 4/1986 | Furuichi | 271/3.1 |
| 4,667,951 | 5/1987 | Honjo et al. | 271/3.1 X |
| 4,727,398 | 2/1988 | Honjo et al. | 271/3.1 X |
| 4,739,369 | 4/1988 | Yoshiura et al. | 271/3.1 X |
| 4,807,790 | 2/1989 | Ushioda et al. | 226/2 |
| 4,834,277 | 5/1989 | Gomott et al. | 226/101 |
| 5,056,775 | 10/1991 | Kida | 271/3 X |

FOREIGN PATENT DOCUMENTS

| | | | |
|---|---|---|---|
| 2912656 | 10/1980 | Fed. Rep. of Germany | 400/708 |
| 3338588 | 5/1984 | Fed. Rep. of Germany . | |
| 3918599 | 12/1989 | Fed. Rep. of Germany . | |
| 3827604 | 2/1990 | Fed. Rep. of Germany . | |

OTHER PUBLICATIONS

Patents Abstract of Japan, vol. 14, No. 147 (M-952), Mar. 20, 1990, and JP-A-02-013-531, Jan. 17, 1990, Arai Hiroyuki et al., "Document Conveyance Device".

*Primary Examiner*—David H. Bollinger

*Attorney, Agent, or Firm*—Oblon, Spivak, McClelland, Maier & Neustadt

[57] ABSTRACT

An automatic document feeding method for a recycling automatic document feeder (RADF) for use with a copier or similar image recording apparatus. The last document to be returned and the document immediately preceding it are discharged in succession. The discharge of the last document occurs on the elapse of a predetermined period of time after the discharge of the immediately preceding document.

8 Claims, 8 Drawing Sheets

Fig. 4A
Fig. 4
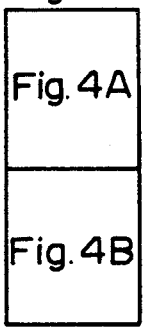
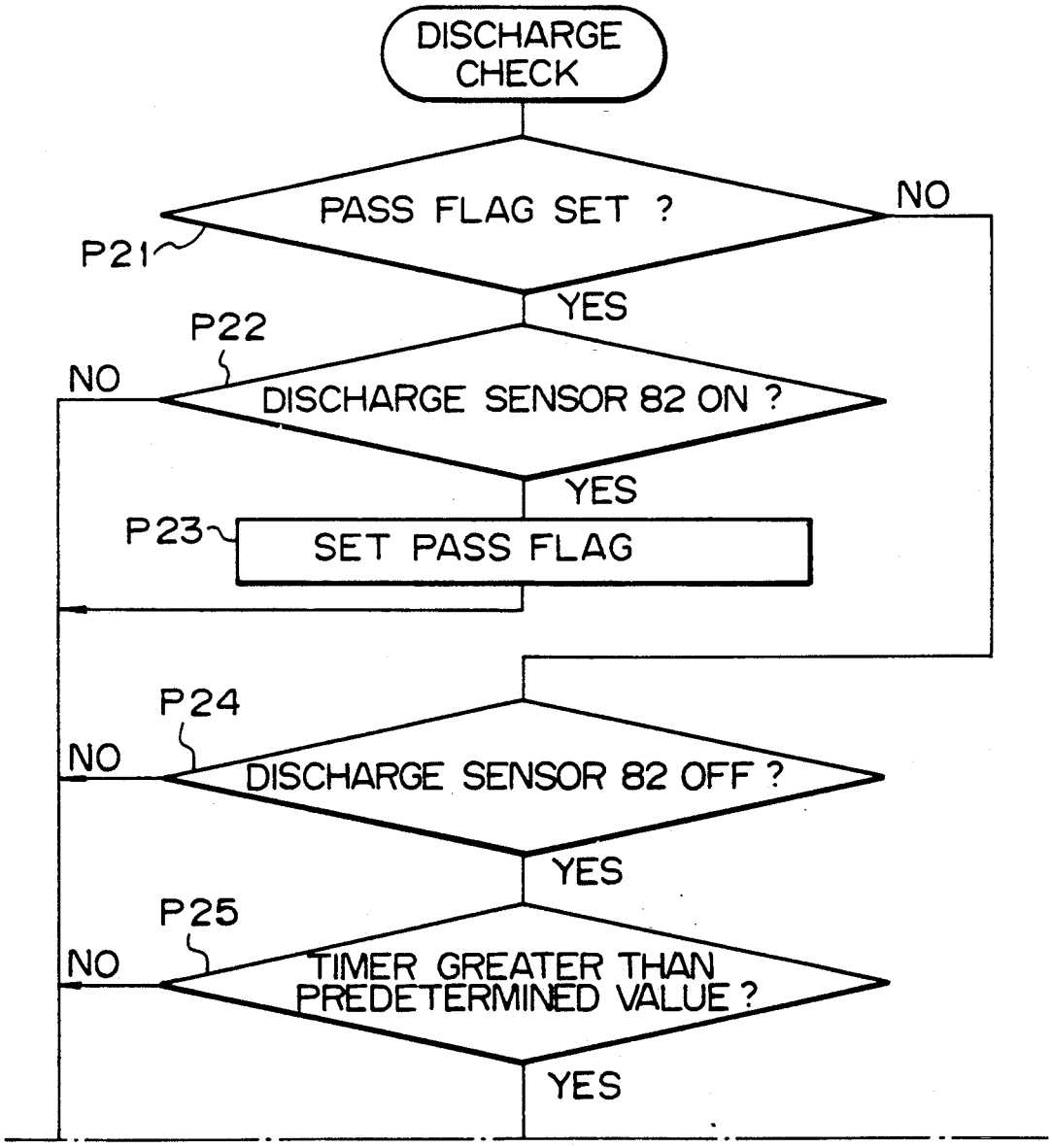

DOCUMENT FEEDING METHOD FOR A RECYCLING AUTOMATIC DOCUMENT FEEDER

This application is a continuation of application Ser. No. 07/723,202, filed on Jun. 28, 1991, now abandoned.

BACKGROUND OF THE INVENTION

The present invention relates to a recycling automatic document feeder (RADF) for use with a copier or similar image recording apparatus and, more particularly, to a document feeding method practicable with an RADF.

An automatic document feeder (ADF) capable of automatically feeding documents one by one to a recording position of a copier or similar image recording apparatus is extensively used today. The ADF is often implemented as an RADF which automatically feeds documents stacked on a table thereof one by one to an exposing position on a glass platen of a copier and returns each of them after they have undergone illumination to the table, i.e., the top of the stack remaining on the table. It is a common practice with the RADF to use a single drive source in driving two independent means, i.e., means for pulling out the documents from the stack one at a time and means for transporting the document to the glass platen of the copier. This is to promote the miniaturization of the RADF. A document feeding method practicable with such an RADF returns a document having been illuminated at the exposing position to the table at the same time as it feeds the next document from the table.

The problem with the conventional automatic document feeding method is that two or more documents cannot be fed by a single document feeding operation and, therefore, the interval between the successive documents is relatively long, resulting in low transport efficiency. Such a method, therefore, obstructs an increase in the operating speed of the RADF. To implement a high-speed RADF, the timings for feeding and returning a document may be changed on the basis of the size of the document so as to reduce the interval between successive documents. Further, the last document to be returned may be discharged to the table almost simultaneously with the immediately preceding document. These schemes, however, bring about another problem that since the interval between the last and immediately preceding documents is short, the last document is apt to contact the preceding document to be thereby bent or caused to get under the immediately preceding document.

SUMMARY OF THE INVENTION

It is therefore an object of the present invention to provide an automatic document feeding method which allows an RADF to operate at high speed while freeing it from discharge errors and thereby insuring accurate stacking of documents which have undergone illumination on a document table.

It is another object of the present invention to provide a generally improved document feeding method for an RADF.

In accordance with the present invention, an automatic document feeding method for feeding a stack of documents set on a table of an ADF one by one to an image recording position of an image recording apparatus on which the ADF is mounted, and discharging each of the documents which have undergone an image recording operation from the recording position such that the last document and the document fed immediately before the last document are discharged in succession comprises the steps of sensing the size of each of the documents sequentially fed from the stack, changing a document feed timing in matching relation to the sensed document size, interrupting the discharging operation for a predetermined period of time after the immediately preceding document has been discharged from the recording position, and resuming the discharging operation on the elapse of the predetermined period of time to discharge the last document from the recording position.

BRIEF DESCRIPTION OF THE DRAWINGS

The above and other objects, features and advantages of the present invention will become more apparent from the following detailed description taken with the accompanying drawings in which:

FIGS. 4A and 4B are a flowchart representative of discharge check processing of the embodiment.

DESCRIPTION OF THE PREFERRED EMBODIMENT

Figure 1:
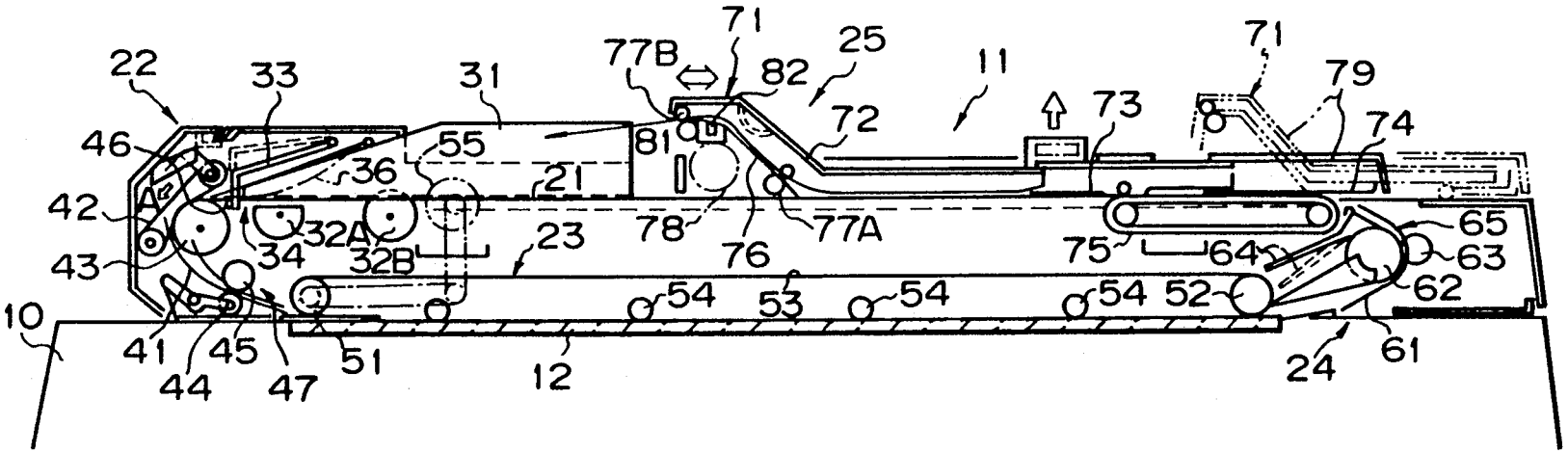
FIG. 1 is a side elevation of an RADF with which an automatic document feeding method of the present invention is practicable.
Figure 2A:
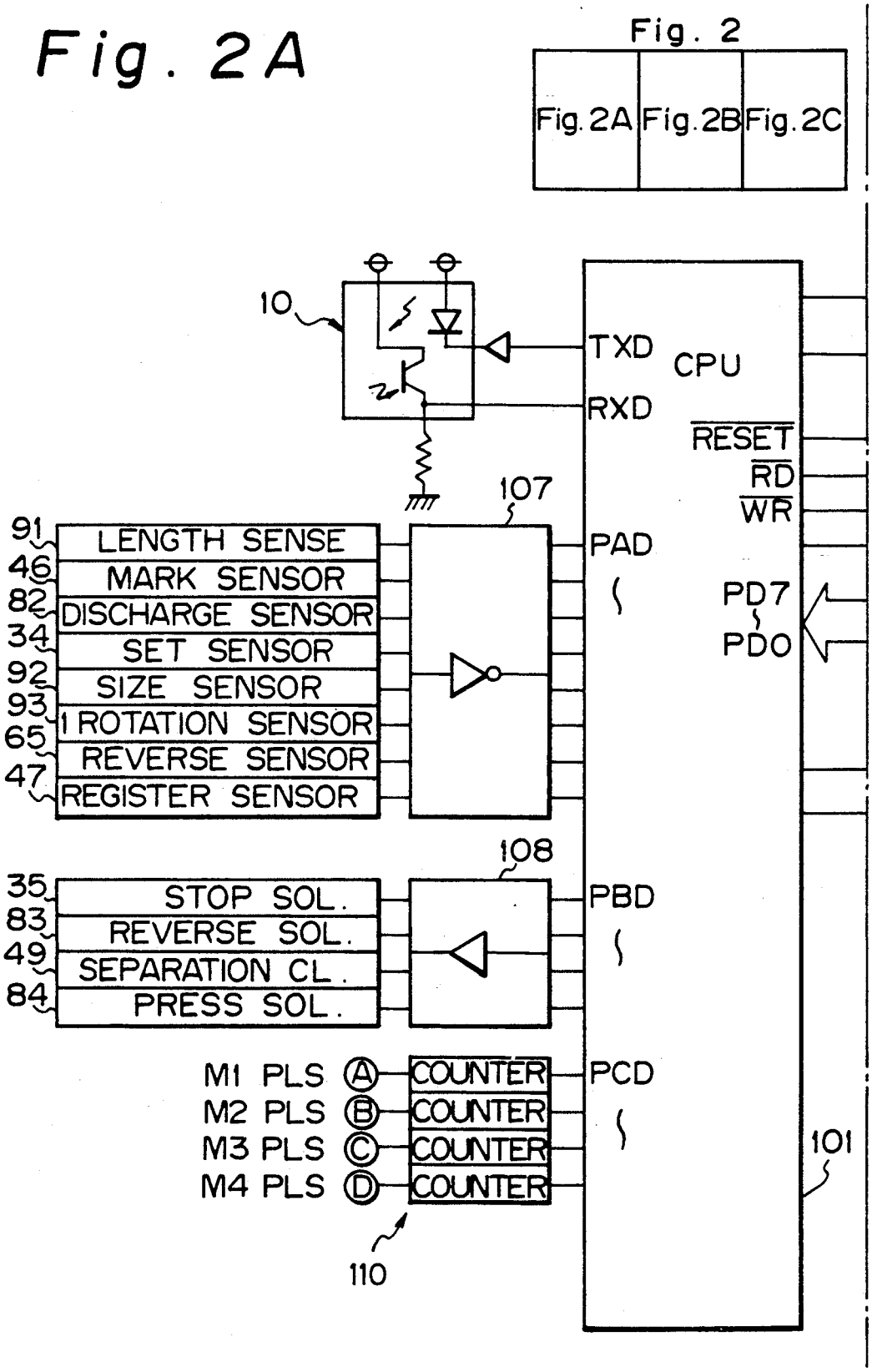
FIGS. 2A, 2B, 2C are a block diagram schematically showing a control system associated with the RADF.
Figure 2B:
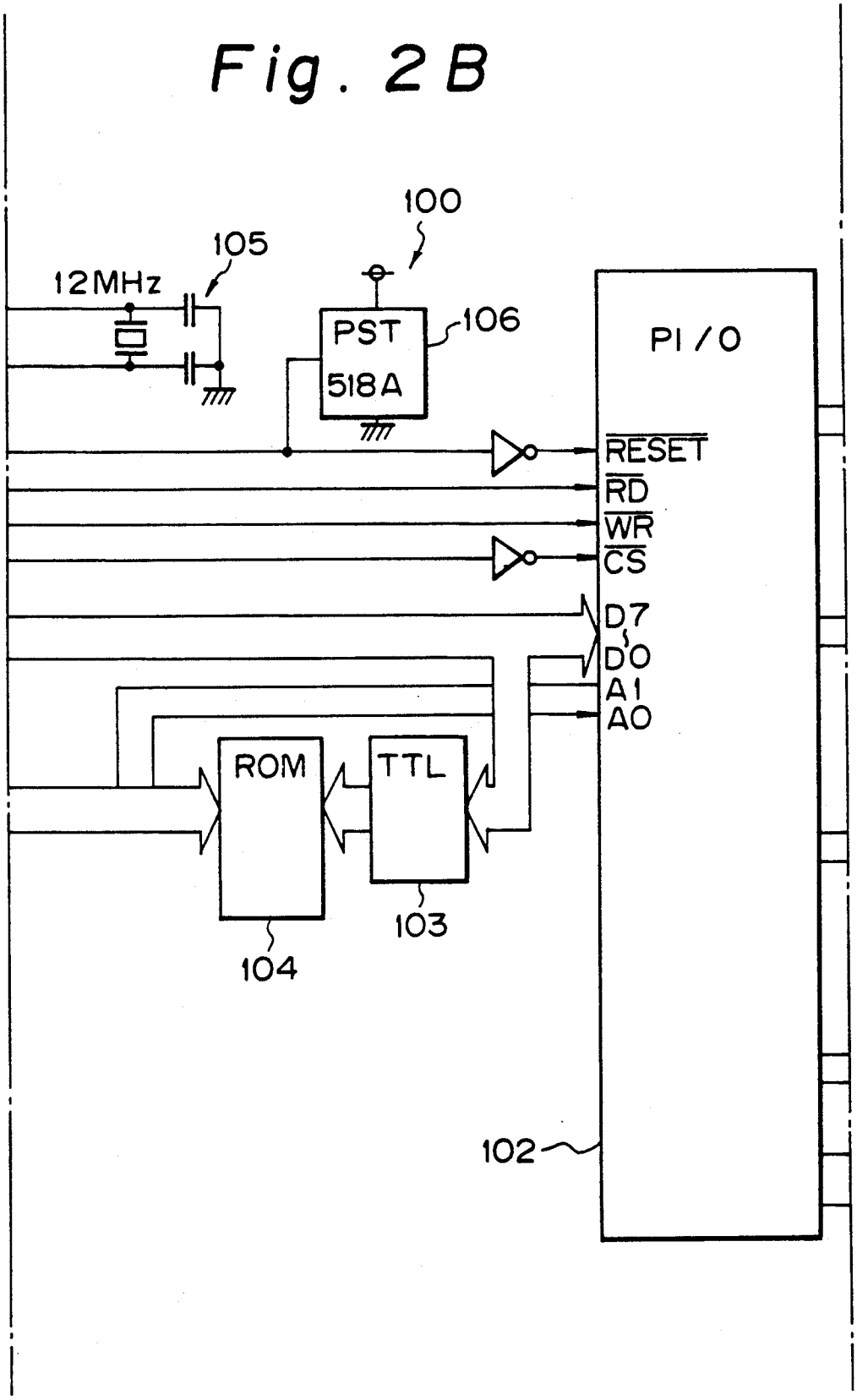
Figure 2C:
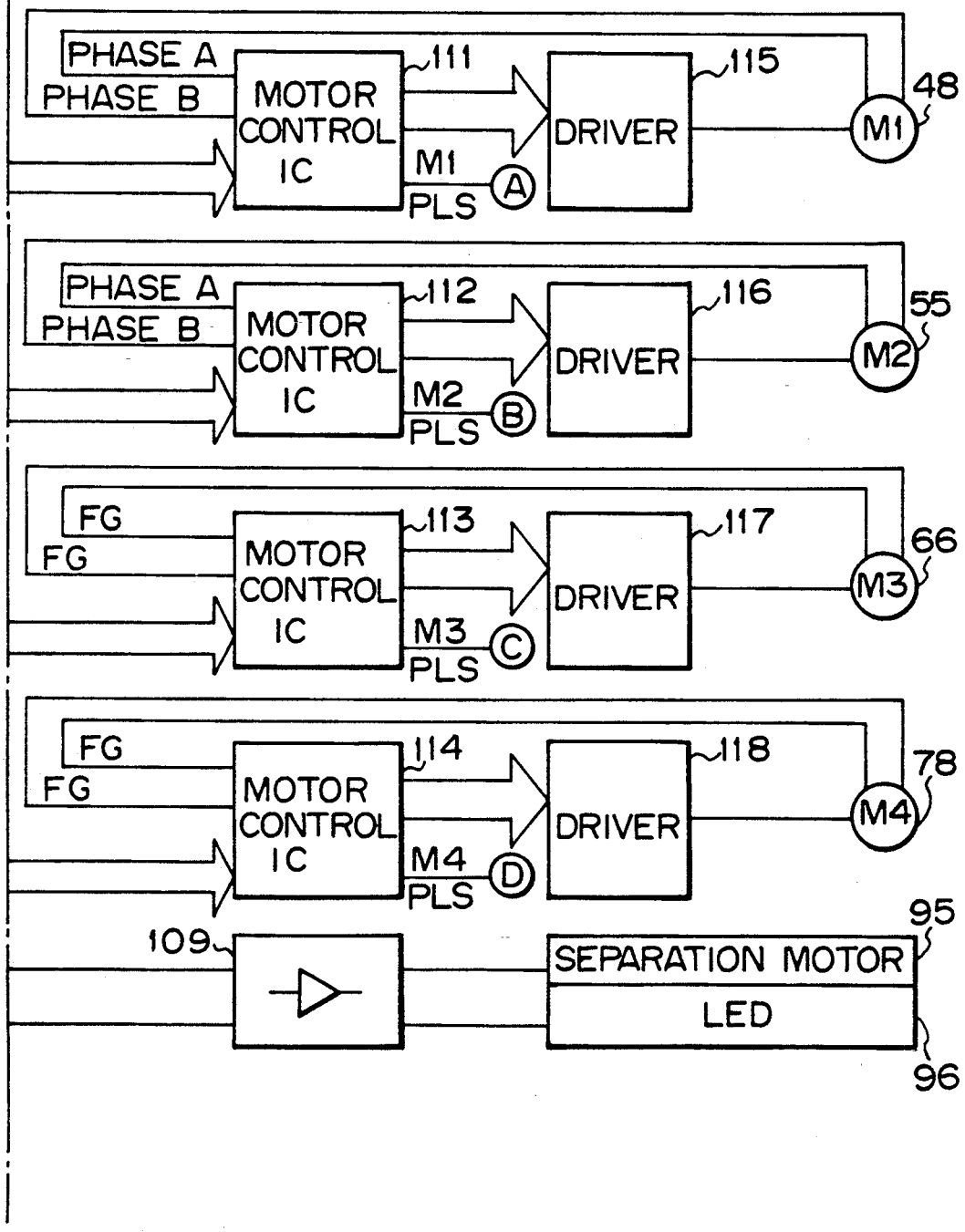

Referring to FIGS. 1 and 2 of the drawings, there are shown an RADF with which the present invention is practicable and a control system associated therewith. As shown, the RADF, generally 11, is mounted on the body 10 of a copier and covers a glass platen 12 provided on the top of the copier body 10. The RADF 11 includes a table 21 to be loaded with a stack of documents, and a feed section 22 for feeding the documents one by one from the table 21 toward the glass plate 12, the lowermost document being first. A transport section 23 conveys the document fed out by the feed section 22 onto the glass platen 12 and then drives it out of the glass platen 12. A reverse section 24 turns over the document driven out by the transport section 23. A return section 25 returns the document coming out of the reverse section 24 to the top of the document stack on the document table 21. A control system 100, FIG. 2, controls the operations of the above-mentioned various sections.

The table 21 is located at one end (upstream side with respect to the direction of document transport) of the RADF 11. A pair of side fences 31 and a plurality of pick-up rollers 32A and 32B are provided on the document table 21. Stops 33 rest on the top of the document stack on the table 21 at the free ends or leading ends thereof by gravity. The document routed through a recycling path, which will be described, and returned from the rear abuts against the leading ends of the stops 33 and is thereby marked off from the documents originally stacked on the table 21. At the same time, the stops 33 serve to prevent such documents from skewing. A document sensor 34 is disposed in front of the pick-up rollers 32A and 32B to determine whether or not documents are present on the table 21. The stops 33 each are supported by the side walls, not shown, of the RADF 11 in such a manner as to be rotatable up and down. The controller 100, FIG. 2, energizes a solenoid, not shown, in response to a start signal which is sent from the copier body 10. Then, the solenoid moves the stops 33 upward to allow the documents turned over and then returned to the table 21 to be fed again. A presser sheet 36 is implemented as a flexible sheet made of Mylar or similar material and located downstream of the stops 33 with respect to the direction of document transport. Also driven by the above-mentioned solenoid, the presser sheet 36 is movable up and down and, during a downward movement, presses the top of the document stack while being deformed.

The feed section 22 has a guide 41 extending from a position adjacent to the stops 33 to one end of the glass platen 12. An endless belt 42 extends along the guide 41. A separation roller 43 is held in pressing contact with the belt 42 and has a one-way clutch, not shown, therein. Pull-out rollers 44 and 45 cooperate to pull out the document separated by the belt 42 and separation roller 43 toward the glass platen 12. A sensor 46 is located on the downstream side of the stops 33 to determine whether or not the last document of the stack loaded on the table 21 has been fed out. A sensor 47 is responsive to the leading and trailing edges of the document being fed. A feed motor 48, FIG. 2, is also included in the feed section 22. The belt 42 and separation roller 43 drive only the lowermost document of the stack to the pull-out rollers 44 and 45 due to the difference in rotation speed between the belt 42 and the roller 43 and the difference in the coefficient of friction between them and the documents. A clutch 49, FIG. 2, selectively interrupts the drive transmission to the separation roller 43. As the sensor, or register sensor, 47 located at a position where the feed section 22 merges into the transport section 23 senses the leading edge of a document, the clutch 49 is uncoupled to interrupt the drive transmission to the separation roller 43. A rotary encoder, not shown, is connected to the pull-out roller 45 which is driven by the other pull-out roller 44. The rotary encoder and register sensor 47 constitute in combination size sensing means for sensing the size of a document.

The transport section 23 has an endless belt 53 passed over a pair of rollers 51 and 52. A plurality of rollers 54 press the lower run of the belt 53 against the glass platen 12. Driven by a motor 55, the transport section 23 transports a document handed over from the feed section 22 to a predetermined exposing position on the glass platen 12 and then drives the document which has undergone illumination out of the glass platen 12 to the reverse section 24. The exposing position is defined such that, for example, the trailing edge of a document substantially coincides with the left end of the glass platen 12, as viewed in FIG. 1. After the register sensor 47 has sensed the trailing edge of a document, the belt 53 is reversed on the basis of the count of the encoder which is responsive to the rotations of the pull-out roller 45.

The reverse section 24 has a curved guide 61 extending upward from the other end of the glass platen 12, a reverse roller 61 whose periphery extends along the guide 61, a pressure roller 63 pressing against the reverse roller 62, a selector in the form of a pawl 64 located downstream of the reverse roller 62 and movable between two positions indicated by a solid line and a phantom line in the figure, a sensor 65 for sensing a document existing in such a reverse transport path, and a motor 66, FIG. 2, for driving the reverse roller 62. The guide 61 is capable of turning over a document which is moving along the reverse transport path. The motor 66 for driving the coactive rollers 62 and 63 is independent of the motor 55 associated with the belt 53. The rotation of the motor 66 is controlled in interlocked relation to the operation of the belt 53 on the basis of the output of the sensor, or reverse sensor, 65. In the solid-line position, the selector 64 guides a document which has undergone illumination (e.g. one-sided document or two-sided document whose one side has been illuminated) to the return section 25. In the phantom-line position, the selector 64 causes the document which has undergone illumination (e.g. two-sided document whose one side has been illuminated) to be turned over and then driven again toward the glass platen 12.

The return section 25 has a discharge unit 71 movable on and along the document table 21 in the direction of document transport, guides 72, 73 and 74 connected to the rear of the discharge unit 71 to constitute a guide section which is contractible in association with the movement of the unit 71, and a belt 75 for transporting a document coming out of the reverse section 24 to the unit 71. The discharge unit 71 has a guide 76 defining a discharge path which extends from the belt 75 to the document table 21, a plurality of pairs of discharge rollers 77A and 77B arranged along the guide 76, a motor 78 for driving the rollers 77A and 77B, and cover 79. When a document stack is so positioned as to abut against the stops 33, a drive means, not shown, moves the return section 25 to a position where the trailing edge of the stack is located. A presser plate 81 is also included in the return section 25 and presses the documents toward the separation roller 43 as soon as the returns section 25 is positioned as mentioned above. Further, a sensor 82 is located in the vicinity of the outlet of the return section 25. The sensor 82 outputs discharge information on sensing a document being returned through the return section 25. This information is applied to the control system 100 shown in FIG. 2 together with the information from the other various sensors.

As shown in FIG. 2, the control system 100 has a CPU 101, an I/O interface 102, a TTL 103, a ROM 104, a clock circuit 105, a reset IC 106, input and output buffers 107, 108 and 109, a counter 110, motor control ICs 111–114, drivers 115–118, etc. The individual components of the control system 100 are conventional and will not be described specifically. Based on control programs stored in the ROM 104, the CPU 101 controls the motors 48, 55, 66 and 78, solenoid 35, a solenoid 83 associated with the selector 64, a solenoid 84 associated with the presser plate 81, etc. Also shown in FIG. 2 are a motor 95 for driving the separation roller 43, and LEDs for display 96.

In operation, a stack of documents are put on the document table 21 face up and such that the leading edge thereof abuts against the stops 33. Then, the opposite side fences are moved toward each other to guide side edges of the document stack, and the discharge unit 71 is shifted to a position matching the size of the documents. As a copy start key provided on the copier body 10 is pressed, the control system 100 drives the various drive lines of the RADF 11. As a result, the lowermost document of the stack laid on the table 21 is fed out by the feed section 22 and transport section 23 to the exposing position defined on the glass platen 12. The register sensor 47 and encoder, i.e., the size sensing means, senses the size of the document being transported. The timings for feeding and returning the document are variably controlled on the basis of the sensed document size.

Specifically, in response to a control signal from the copier body 10, the pick-up rollers 32A and 32B contacting the underside of the document stack are driven to feed the lowermost document to the endless belt 42 and separation roller 43. The belt 42 and roller 43 in turn drive the lowermost document toward the pull-out rollers 44 and 45. At this instant, the stops 33 have been moved upward. The document reaching the pull-out rollers 44 and 45 is further driven by the rollers 44 and 45 and the belt 53 to the exposing position on the glass platen 12. The previously stated size sensing means senses the size of the document being so transported. The operations of the pick-up rollers 32A and 32B and feed section 22 are controlled on the basis of the sensed document size, whereby the document transport timing is controlled to maintain the interval between successive documents minimum within a predetermined range. As a result, the greatest number of documents can be sequentially fed to the glass platen 12 in a given period of time in associated with the document size, enhancing rapid document feed.

The document located in the exposing position on the glass platen 12 is illuminated by a scanner incorporated in the copier body 10.

The reverse section 24 and return section 25 discharge the document which has undergone illumination to the top of the document stack on the table 21 while turning it over. Specifically, the belt 53 transports the document having been illuminated to the reverse section 24. The reverse roller 62 and pressure roller 63 in the reverse section 24 drive the document along the guide 61, thereby turning over the document. On reaching the return section 25, the document is conveyed by the belt 75 along the guides 72, 73 and 74 and then driven out onto the top of the document stack on the table 21 by the discharge rollers 77A and 77B and guide 76. The documents sequentially driven out of the return section 25 in the above-described manner abut against the stops 33 and are thereby marked off from the underlying documents originally stacked on the table 21.

Figure 3:
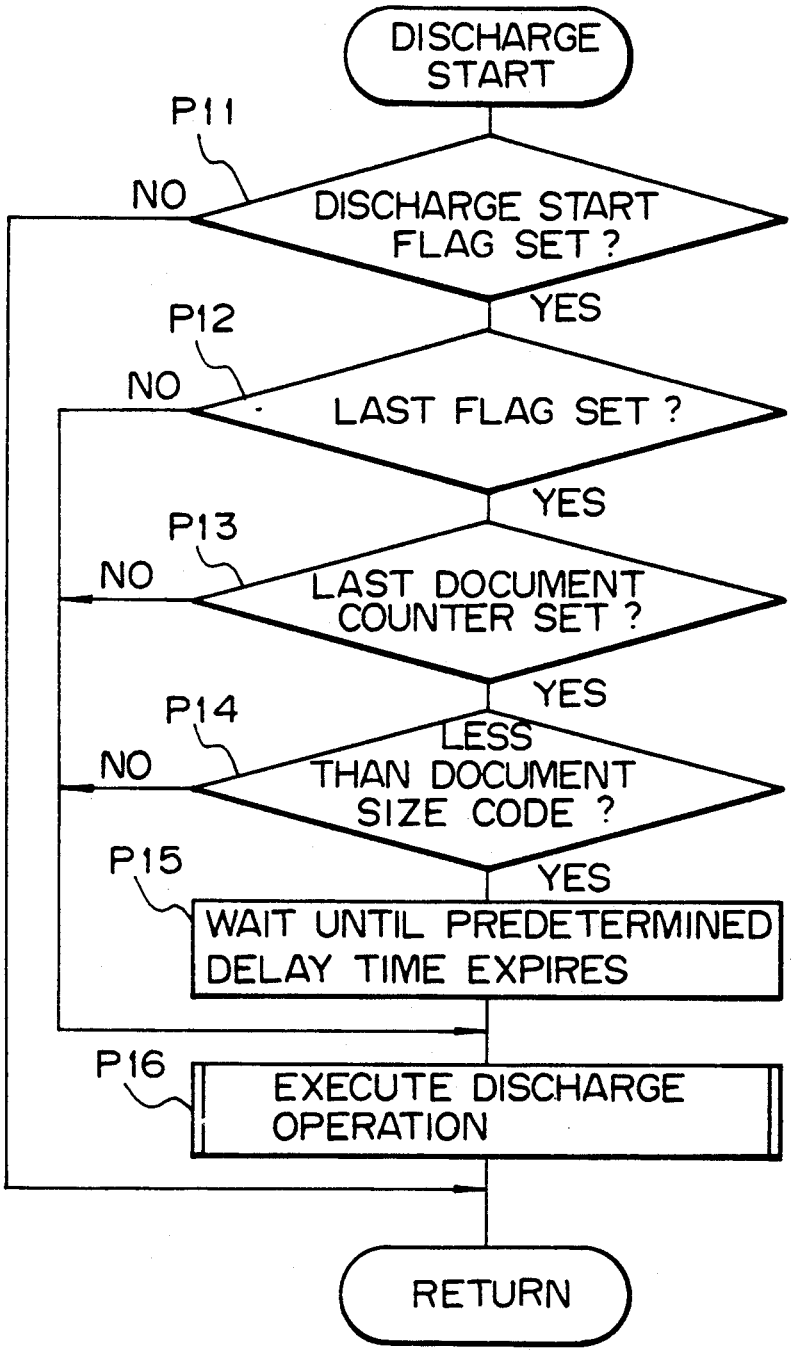
FIG. 3 is a flowchart demonstrating discharge processing particular to the embodiment.
Figure 4B:
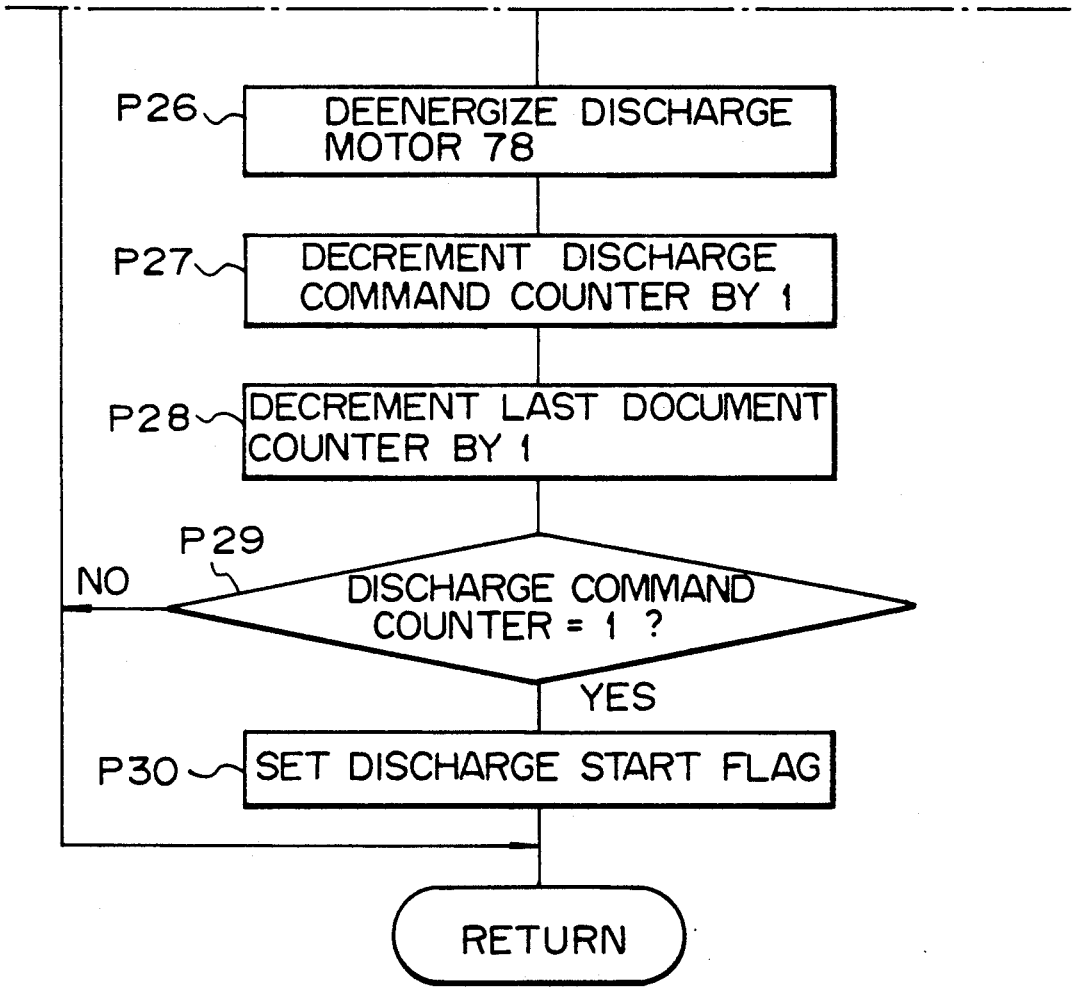
Figure 5:
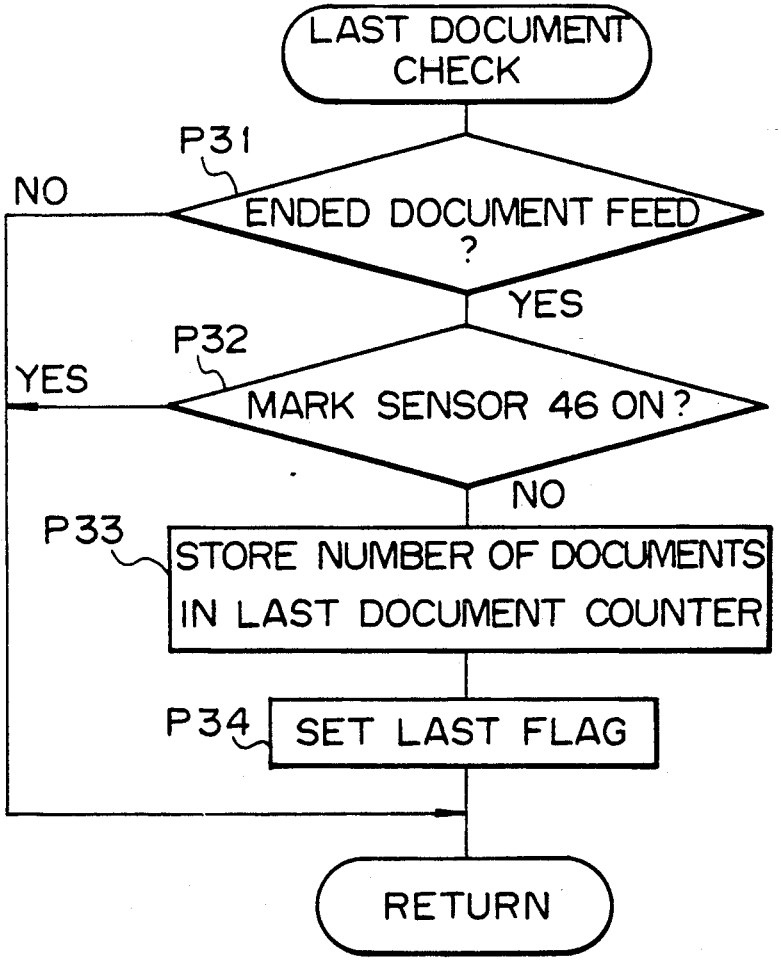
FIG. 5 is a flowchart showing last document check processing of the embodiment.

In the illustrative embodiment, the CPU 101 of the control system 100 executes specific procedures relating to the discharge of documents, as shown in FIGS. 3 through 5. In FIG. 3, the CPU 101 determines whether or not a discharge start flag is set (step P11) and, if the answer is YES, whether or not a last flag is set (P12). If the answer of the step P12 is YES, the CPU 101 determines whether or not the count of a last document counter built in the CPU 101 is "1" (P13). If the answer of the step P13 is YES, the CPU 101 determines whether or not the document size is relatively small such as LTY (letter size, horizontally long) (P14). If the answer of any one of the steps P12–P14 is NO, the program is transferred to a step P16 for executing an ordinary discharging operation.

Assume that the documents are sequentially fed, illuminated and then returned until only the last document of the stack originally put on the table 21 has been left on the table 21. Then, the last document is fed toward the glass platen 12 after the document having been laid in the exposing position on the glass platen 12. At this time, if the document size is relatively small, two documents are laid on the glass platen 12. In the illustrative embodiment, after the last document has been illuminated, the preceding document and the succeeding or last document are sequentially returned to the top of the document stack in succession. At this instant, after the discharge of the preceding one of the two documents onto the document stack, the discharging operation is interrupted for a predetermined period of time, and then the last document is discharged.

Specifically, in FIG. 3, if all the answers of the steps P12–P14 are YES, the CPU 101 waits until a predetermined delay time expires (P15) and then executes the discharging operation (P16). The predetermined delay time is selected such that the two successive documents of interest do not contact each other during the discharge, i.e., they are surely discharged while being separated from each other. Therefore, even if the interval between the last document and the immediately preceding document is short, the former is prevented from contacting the latter. This is successful in preventing the last document from being bent by the preceding document or from getting under the latter.

FIG. 4 shows discharge check processing. In this procedure, the CPU 101 determines whether or not a pass flag is set (P21) and, depending on the result of decision, whether or not the discharge sensor 82 has turned on (P22) or turned off (P24). If the discharge sensor 82 has turned on, the CPU 101 sets the pass flag (P23). If the discharge sensor 82 has turned off as determined in the step P24, the CPU 101 checks a timer built therein to see if a predetermined period of time has elapsed (P25). If the answer of the step P25 is YES, the CPU 101 deenergizes the discharge motor 78 (P26). Then, the CPU 101 decrements a discharge command counter also built therein (P27) and then decrements the last document counter (P28). The step S28 is followed by a step P29 for determining whether or not the discharge command counter is "1". If the answer of the step S29 is YES, the CPU 101 sets the discharge start flag (P30).

FIG. 5 shows a last document check procedure. As shown, the CPU 101 determines whether or not the feed of documents has ended (P31) and, if the answer is YES, whether or not the sensor 46 has turned on (P32). If the sensor 46 has turned off, meaning that there does not exist the leading edge of a document ahead of the stop 33 (i.e. the last document has been fed), the CPU 101 stores the number of documents having not been discharged and existing in the transport path in the last document counter. Thereafter, the CPU 101 sets a last flag.

As stated above, in the illustrative embodiment, the CPU 101 of the control system 100 allows the last document to be returned immediately after the preceding document and, at this instant, discharges the last document on the elapse of a predetermined period of time after the preceding document. The RADF 11, therefore, is operable at high speed and, yet, is free from discharge errors and can surely stack documents again on the document table 21.

Various modifications will become possible for those skilled in the art after receiving the teachings of the present disclosure without departing from the scope thereof.

What is claimed is:

1. An automatic document feeding method for feeding a stack of documents set on a table of an automatic document feeder (ADF) one by one to an image recording position on a portion of a glass platen of an image recording apparatus on which said ADF is mounted, and discharging, by a document discharging means, each of said documents which has undergone an image recording operation from said recording position such that a last document and a document immediately preceding said last document are discharged in succession, and wherein when a document immediately preceding said last document is in the image recording position, the last document is located on the glass platen in a position other than the image recording position and close to the document discharging means, said method comprising the steps of:

(a) sensing the size of each of the documents sequentially fed from the stack;

(b) changing a document feed timing in matching relation to the sensed document size, whereby an interval between feeding successive documents is maintained within a predetermined range;

(c) interrupting a discharging operation for a predetermined period of time after the immediately preceding document has been discharged from said recording position; and (d) resuming said discharging operation on the elapse of said predetermined period of time to discharge the last document from said recording position.

2. A method as claimed in claim 1, wherein the lowermost document of the stack is fed first, the last document being the uppermost document of said stack.

3. A method as claimed in claim 2, further comprising the step of (e) returning the documents sequentially discharged to the top of the stack.

4. A method as claimed in claim 3, wherein step (c) comprises the further step of (f) interrupting said discharging operation for said predetermined period of time after the immediately preceding document has been returned onto the stack.

5. A method as claimed in claim 4, wherein step (b) comprises the further step of (g) changing a document returning timing in matching relation to the sensed document size.

6. A method as claimed in claim 1, wherein said image recording apparatus comprises a copier, said recording position comprising an exposing position defined on a glass platen of said copier.

7. An automatic document feeder comprising:

stacking means to be loaded with a stack of documents thereon;

feeding means for separating and feeding the documents one by one from said document stacking means;

transporting means for stopping the document fed by said feeding means at an illuminating position defined on a glass platen, and, after said document has been illuminated, transporting said document in the same direction as a direction in which said document has been fed to said illuminating position;

discharging means for transporting the document undergone illumination in the same direction as the direction of transport by said transporting means to thereby drive said document out of said automatic document feeder;

size sensing means for sensing a size of the document fed by said feeding means;

identifying means for identifying the documents being transported by said feeding means and said transporting means as the last document; and control means for determining the times for said feeding means, said transporting means and said discharging means to transport the document in matching relation to the size of said document sensed by said size sensing means such that, when the size of the document is smaller than a predetermined size, the document immediately preceding the document located at the illuminating position is also present on said glass platen downstream of said illuminating position and, after said document at said illuminating position has been illuminated, transported by said transporting means to said discharging means to allow said document at said illuminating position to be discharged by said discharging means without interruption, the document identified as the last document by said identifying means and smaller than said predetermined size is transported to said discharging means by said transporting means after illumination, and said discharging means, on receiving said last document, interrupts a discharging operation for a predetermined period of time and, on the elapse of said predetermined period of time, resumes the discharging operation.

8. An automatic document feeder comprising:

stacking means to be loaded with a stack of documents thereon;

feeding means for separating and feeding the document one by one from said document stacking means;

transporting means for stopping the documents fed by said feeding means at an illuminating position defined on a glass platen and, after said documents have been illuminated, transporting said documents in a same direction as a direction in which said documents had been fed to said illuminating position;

discharging means for transporting the documents which have undergone illumination in the same direction as the direction of transport by said transporting means to thereby drive said documents out of said automatic document feeder;

size sensing means for sensing a size of the documents fed by said feeding means;

identifying means for identifying a last document of the documents being transported by said feeding means and said transporting means; and control means for determining a feed timing rate of said feeding means, said transporting means and said discharging means to transport the documents in matching relation to the size of said documents sensed by said size sensing means such that, when the size of a sensed document is smaller than a predetermined size, a document immediately preceding the sensed document located at the illuminating position is also present on said glass platen downstream of said illuminating position and, after said sensed document at said illuminating position has been illuminated and transported by said transporting means to said discharging means to allow said sensed document at said illuminating position to be discharged by said discharging means without interruption, the document identified as the last document by said identifying means and which is smaller than said predetermined size is transported to said discharging means by said transporting means after illumination, and said discharging means, on receiving said last document, interrupts a discharging operation for a predetermined period of time and, on the elapse of said predetermined period of time, resumes the discharging operation.

* * * * *